US011591775B2

(12) United States Patent
Ono et al.

(10) Patent No.: US 11,591,775 B2
(45) Date of Patent: Feb. 28, 2023

(54) HYDRAULIC CIRCUIT FOR CONSTRUCTION MACHINE, AND HYDRAULIC CIRCUIT

(71) Applicants: Yanmar Power Technology Co., Ltd., Osaka (JP); Nabtesco Corporation, Tokyo (JP)

(72) Inventors: Junya Ono, Fukuoka (JP); Hiroshi Matsuyama, Fukuoka (JP); Naoto Kageyama, Fukuoka (JP); Hitoshi Iwasaki, Tokyo (JP); Nanami Tukahara, Tokyo (JP)

(73) Assignees: Yanmar Power Technology Co., Ltd., Osaka (JP); Nabtesco Corporation, Tokyo (JP)

( * ) Notice: Subject to any disclaimer, the term of this patent is extended or adjusted under 35 U.S.C. 154(b) by 0 days.

(21) Appl. No.: 17/440,753

(22) PCT Filed: Mar. 6, 2020

(86) PCT No.: PCT/JP2020/009846
§ 371 (c)(1),
(2) Date: Sep. 17, 2021

(87) PCT Pub. No.: WO2020/189352
PCT Pub. Date: Sep. 24, 2020

(65) Prior Publication Data

US 2022/0195702 A1 Jun. 23, 2022

(30) Foreign Application Priority Data

Mar. 19, 2019 (JP) ..... JP2019-050815

(51) Int. Cl.
*E02F 9/22* (2006.01)
*E02F 3/32* (2006.01)
*E02F 3/42* (2006.01)

(52) U.S. Cl.
CPC ..... *E02F 9/2267* (2013.01); *E02F 9/2242* (2013.01); *E02F 9/2292* (2013.01);
(Continued)

(58) Field of Classification Search
CPC ..... E02F 9/2239; E02F 9/2292; F15B 2211/20538; F15B 2211/20546
See application file for complete search history.

(56) References Cited

U.S. PATENT DOCUMENTS

2015/0211501 A1* 7/2015 Yamada ..... F04B 49/06 417/222.1

FOREIGN PATENT DOCUMENTS

JP 356016735 A * 2/1981 ..... E02F 9/2239
JP 2012112466 A * 6/2012
(Continued)

*Primary Examiner* — Thomas E Lazo
(74) *Attorney, Agent, or Firm* — Chris Mizumoto

(57) ABSTRACT

Provided is a hydraulic circuit, for a construction machine, which drives an actuator by merging pressure oil from a fixed-volume pump into a center bypass oil path from a variable-volume pump to an oil tank, wherein the flow rate of flow from the fixed-volume pump to the center bypass oil path can be controlled in accordance with a requested flow rate of the actuator. A distribution direction-switching valve, which has a first oil path from a fixed-volume pump to an oil tank and a second oil path from the fixed-volume pump to a first center bypass oil path, has a first signal reception unit which causes a spool to slide in a direction in which the first oil path is formed, and a second signal reception unit which causes a spool to slide in a direction in which the second oil path is formed, and determines a distribution ratio of pressure oil flowing to the first oil path and the second oil path in accordance with the difference in size of the signals received by the first signal reception unit and the second
(Continued)

signal reception unit, the first signal reception unit receiving a signal based on a negative control signal.

6 Claims, 2 Drawing Sheets

(52) U.S. Cl.
CPC ..... *E02F 9/2296* (2013.01); *E02F 3/325* (2013.01); *E02F 3/425* (2013.01)

(56) References Cited

FOREIGN PATENT DOCUMENTS

WO WO-2009123047 A1 * 10/2009 ..... E02F 9/2225
WO WO-2015025713 A1 * 2/2015 ..... E02F 9/2239

* cited by examiner

HYDRAULIC CIRCUIT FOR CONSTRUCTION MACHINE, AND HYDRAULIC CIRCUIT

CROSS-REFERENCE

This application is a US National Stage Application under 35 U.S.C. § 371 of International Application No. PCT/JP2020/009846 filed Mar. 6, 2020, which claims foreign priority of JP2019-050815 filed Mar. 19, 2019, the disclosures of which are hereby incorporated by reference in their entirety.

TECHNICAL FIELD

The present disclosure relates to a hydraulic circuit for a construction machine, and a hydraulic circuit used in a work vehicle, etc., such as a construction machine.

BACKGROUND ART

Patent Literature 1 listed below discloses a technique for a hydraulic circuit for a construction machine configured to perform a negative control (hereinafter, also referred to as "neg-con") of a split flow type variable-volume piston pump, in which while the negative control is performed by a lower one of a first neg-con pressure detected in a first open center bypass and a second neg-con pressure detected in a second open center bypass, when the first neg-con pressure is higher than the second neg-con pressure, a discharging flow rate of a pump is reduced by unloading an amount of oil, which corresponds to a pressure difference between the first neg-con pressure and the second neg-con pressure, from a first unload valve provided upstream of the first open center bypass, whereby the flow rate of the first open center bypass is reduced.

Patent Literature 2 listed below discloses a technique for a hydraulic system for a construction machine using an open-centered valve as a flow rate/direction control valve for controlling a flow of a hydraulic oil to be supplied from a variable-volume hydraulic pump and a fixed-volume hydraulic pump to an actuator, in which a bypass switching valve, which forms a bypass oil path leading to an oil tank, is disposed upstream of a center bypass oil path extending from the fixed-volume hydraulic pump to the oil tank, and the bypass switching valve is switched to the bypass oil path leading to the oil tank when the flow rate/direction control valve disposed in the center bypass oil path is neutral, whereby the discharge amount of the fixed-volume hydraulic pump is kept low.

CITATION LIST

Patent Literature

Patent Literature 1: WO 2009/123047
Patent Literature 2: Japanese Unexamined Patent Application Publication No. 2012-112466

DISCLOSURE OF INVENTION

Problems to be Solved by the Invention

In the hydraulic circuit disclosed in Patent Literature 1, for compensating an oil shortage during a combined operation of a work machine actuator and a travelling motor, the hydraulic circuit is designed so that a rate of flow flowing to the center bypass flow path is made as low as possible if the hydraulic oil of the fixed-volume hydraulic pump provided separately from the split flow type variable-volume piston pump is joined to the center bypass flow path. Thus, a bleed-off opening area of a direction-switching valve provided in the center bypass flow path is set small. Therefore, when a required flow rate of the work machine actuator is tried to be lowered during the combined operation, the pressure in the center bypass flow path abnormally rises, so that the energy loss is increased. In addition, in the construction machine like a hydraulic excavator, for preventing an engine stall, there is usually provided with a control for lowering a discharge a flow rate of the variable-volume piston pump when the pressure of the hydraulic circuit rises when the pressure of the hydraulic circuit is input to a regulator of the variable-volume piston pump, so that movement of the actuator becomes significantly slower as the discharge flow rate of the pump reduces, which causes deterioration of operability.

Furthermore, according to the technology of Patent Literature 2, although it is possible to pseudo-control the discharge amount of the fixed-volume hydraulic pump, it is not possible to perform a control in accordance with the required flow rate of the actuator.

In view of the forgoing, an object of the disclosure is to provide a construction machine hydraulic circuit configured to drive an actuator while joining a hydraulic oil from a fixed-volume pump to a center bypass oil path which extends from a variable-volume pump to an oil tank, in which a rate of flow flowing from the fixed-volume pump to the center bypass oil path is able to be controlled according to a required flow rate of the actuator.

Means for Solving the Problems

A hydraulic circuit for a construction machine according to the disclosure includes an engine, a variable-volume pump and a fixed-volume pump which are driven by the engine, a center bypass oil path extending from the variable-volume pump to an oil tank, and a negative control throttle positioned most downstream of the center bypass oil path, the hydraulic circuit being configured to detect an oil pressure upstream of the negative control throttle as a negative control signal, and to control the variable-volume pump based on the negative control signal, further includes a direction-switching valve including a first oil path extending from the fixed-volume pump to the oil tank and a second oil path extending from the fixed-volume pump to the center bypass oil path, the first oil path and the second oil path being formed by sliding of a spool, wherein the direction-switching valve includes: a first signal reception unit for receiving a signal for sliding the spool in a direction forming the first oil path and a second signal reception unit for receiving a signal for sliding the spool in a direction forming the second oil path, a distribution ratio of the hydraulic oil to be supplied to the first oil path and the second oil path is determined according to a difference in magnitude between the signals respectively received by the first signal reception unit and the second signal reception unit, and the first signal reception unit receives a signal based on the neg-con signal.

According to the present disclosure, in a hydraulic circuit of a construction machine in which the actuator is driven while joining a hydraulic oil from a fixed-volume pump to a center bypass oil path which extends from a variable-volume pump to an oil tank, the hydraulic oil flowing to the center bypass oil path from the fixed-volume pump is partly returned to the oil tank based on a magnitude of a negative control signal generated at a negative control throttle located downstream of the center bypass oil path, whereby the rate of flow flowing from the fixed-volume pump to the center bypass oil path is able to be controlled according to the required flow rate of the actuator.

DESCRIPTION OF EMBODIMENTS

In the following, embodiments of the present disclosure will be described with reference to the drawings.

(Structure of Construction Machine)

Figure 1:
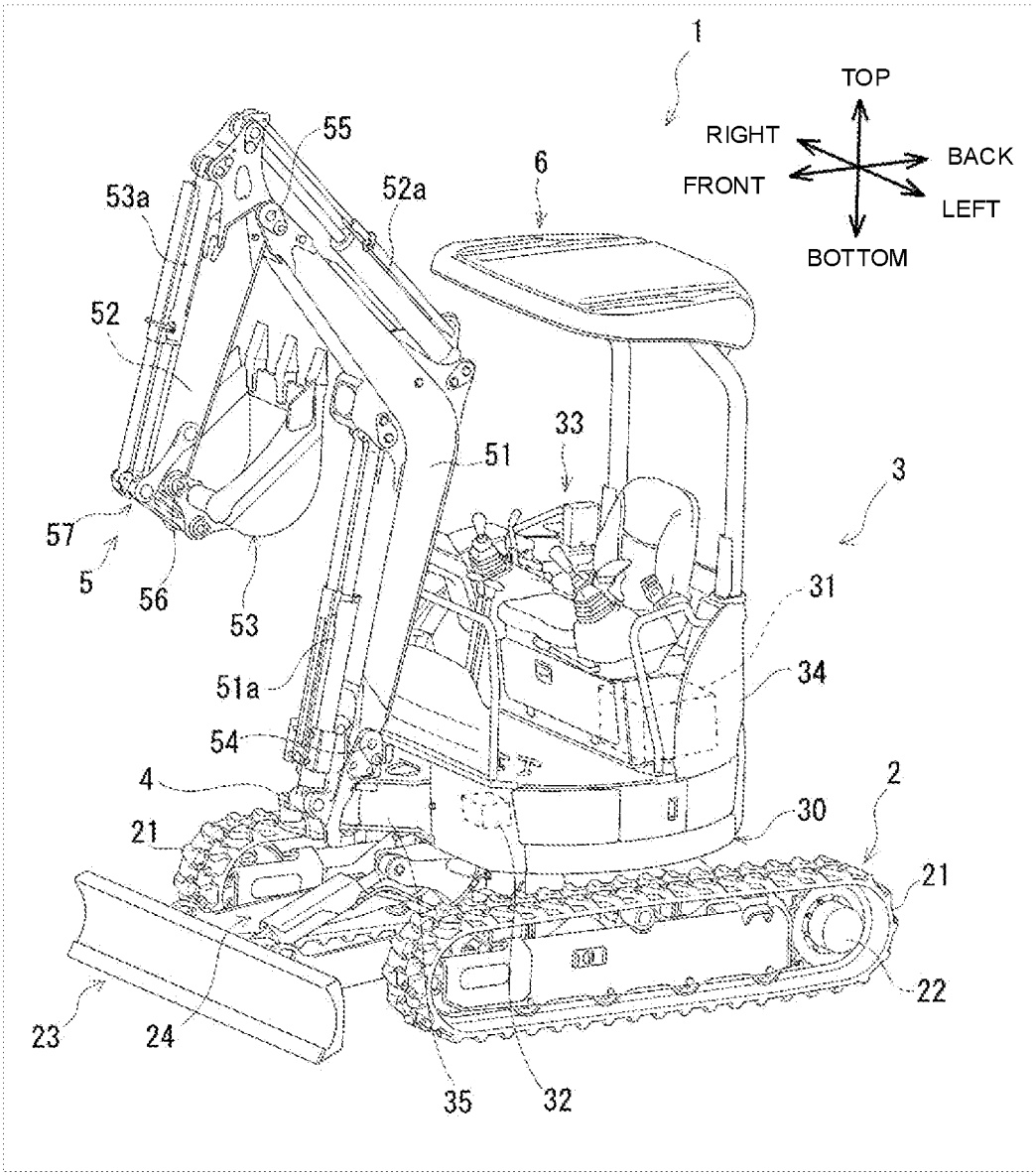
FIG. 1 is a perspective view illustrating a construction machine according to an embodiment of the present disclosure.

As illustrated in FIG. 1, a construction machine 1 includes a lower traveling body 2, a revolving superstructure 3 provided to be revolvable above the lower traveling body 2, a boom bracket 4 which is a swing body supported on the revolving superstructure 3 in a horizontally rotatable manner, and a work machine 5 which is supported on the boom bracket 4 in a vertically rotatable manner. The construction machine 1 is configured as an excavator (backhoe) with a boom swing function. In general, the boom swing function is provided in a compact excavator in which workability in a narrow space is required.

The lower traveling body 2 is driven under power from an engine 31, and allows the construction machine 1 to travel and turn. The lower traveling body 2 has a pair of left and right crawlers 21, 21, and a pair of left and right traveling motors 22, 22 for driving the crawlers 21, 21 (the right traveling motor 22 is not illustrated in FIG. 1). The left and right traveling motors 22, 22, which are hydraulic motors, respectively drive the left and right crawlers 21, 21, thereby enabling forward/backward travelling of the construction machine 1. Furthermore, the lower traveling body 2 is provided with a blade 23 and a blade cylinder 24 which is a hydraulic actuator for vertically rotating the blade 23.

The revolving superstructure 3 is configured to be able to perform a revolving operation about an axis which extends vertically at a central portion of the revolving superstructure 3. The engine 31, a turning motor 32, a maneuvering unit 33, etc., are disposed in the revolving superstructure 3. The maneuvering unit 33 is equipped with a driving seat, an operating device, etc.

The boom bracket 4 is mounted at a front end of the revolving superstructure 3 via a mounting portion 35. The boom bracket 4 is supported by the mounting portion 35 in a horizontally rotatable (that is, laterally swingable) manner. A swing cylinder 40 (not illustrated in FIG. 1), which performs an extension and contraction motion in a front-back direction, is provided between the revolving superstructure 3 and the boom bracket 4. The horizontal rotation of the boom bracket 4 is performed according to the extension and contraction of the swing cylinder 40.

The work machine 5 is driven under the power from the engine 31, and performs a soil excavation work, etc., under control from the maneuvering unit 33. The work machine 5 is supported on the boom bracket 4 in a vertically rotatable manner. The boom bracket 4 is provided with a pivot pin 54 having an axis oriented in the horizontal direction. A proximal end of the work machine 5 (which is a proximal end of a boom 51 described later) is supported in a manner vertically rotatable about the pivot pin 54. The work machine 5 is able to perform a swing motion in conjunction with the horizontal rotation of the boom bracket 4.

The work machine 5 includes a boom 51, an arm 52, and a bucket 53. The boom 51 is mounted to the boom bracket 4 in a vertically rotatable manner. The boom 51 vertically extends from its proximal end supported by the boom bracket 4, and is curved in a boomerang shape in a side view. A boom cylinder 51*a*, which is movable in an extensible and contractible manner, is provided between the boom bracket 4 and an intermediate portion of the boom 51. The vertical rotation of the boom 51 with respect to the boom bracket 4 is performed in accordance with the extension and contraction of the boom cylinder 51*a*.

The arm 52 is mounted to the boom 51 in a vertically rotatable manner. A pivot pin 55 having an axis oriented in the horizontal direction is provided at a distal end of the boom 51. A proximal end of the arm 52 is supported in a manner vertically rotatable (rotatable back and forth) about the pivot pin 55. An arm cylinder 52*a*, which is movable in an extensible and contractible manner, is provided between an intermediate portion of the boom 51 and the proximal end of the arm 52. The vertical rotation of the arm 52 with respect to the boom 51 is performed in accordance with the extension and contraction of the arm cylinder 52*a*.

The bucket 53 is mounted to the arm 52 in a vertically rotatable manner. A pivot pin 56 having an axis oriented in the horizontal direction is provided at a distal end of the arm 52. A proximal end of the bucket 53 is supported in a manner vertically rotatable (rotatable back and forth) about the pivot pin 56. A bucket link 57 is interposed between the distal end of the arm 52 and the bucket 53. The bucket link 57 is configured as a link for transmitting a driving force to the bucket 53. A bucket cylinder 53*a*, which is movable in an extensible and contractible manner, is provided between the bucket link 57 and the proximal end of the arm 52. The vertical rotation of the bucket 53 with respect to the arm 52 is performed in accordance with the extension and contraction of the bucket cylinder 53*a*.

The revolving superstructure 3 has the engine 31, a battery, a fuel tank, etc., which are placed on a turning frame 30 and covered with a bonnet 34, and further has the maneuvering unit 33 positioned at the front thereof. A hydraulic pump is connected to the engine 31 and driven by the engine 31, thereby discharging a hydraulic oil. The hydraulic oil discharged from the hydraulic pump is supplied to the boom cylinder 51*a*, the arm cylinder 52*a*, the bucket cylinder 53*a*, the traveling motors 22, 22, the blade cylinder 24, the turning motor 32, the swing cylinder 40, etc., via a hydraulic hose, a control unit, etc.

(Structure of Hydraulic Circuit)

Figure 2:
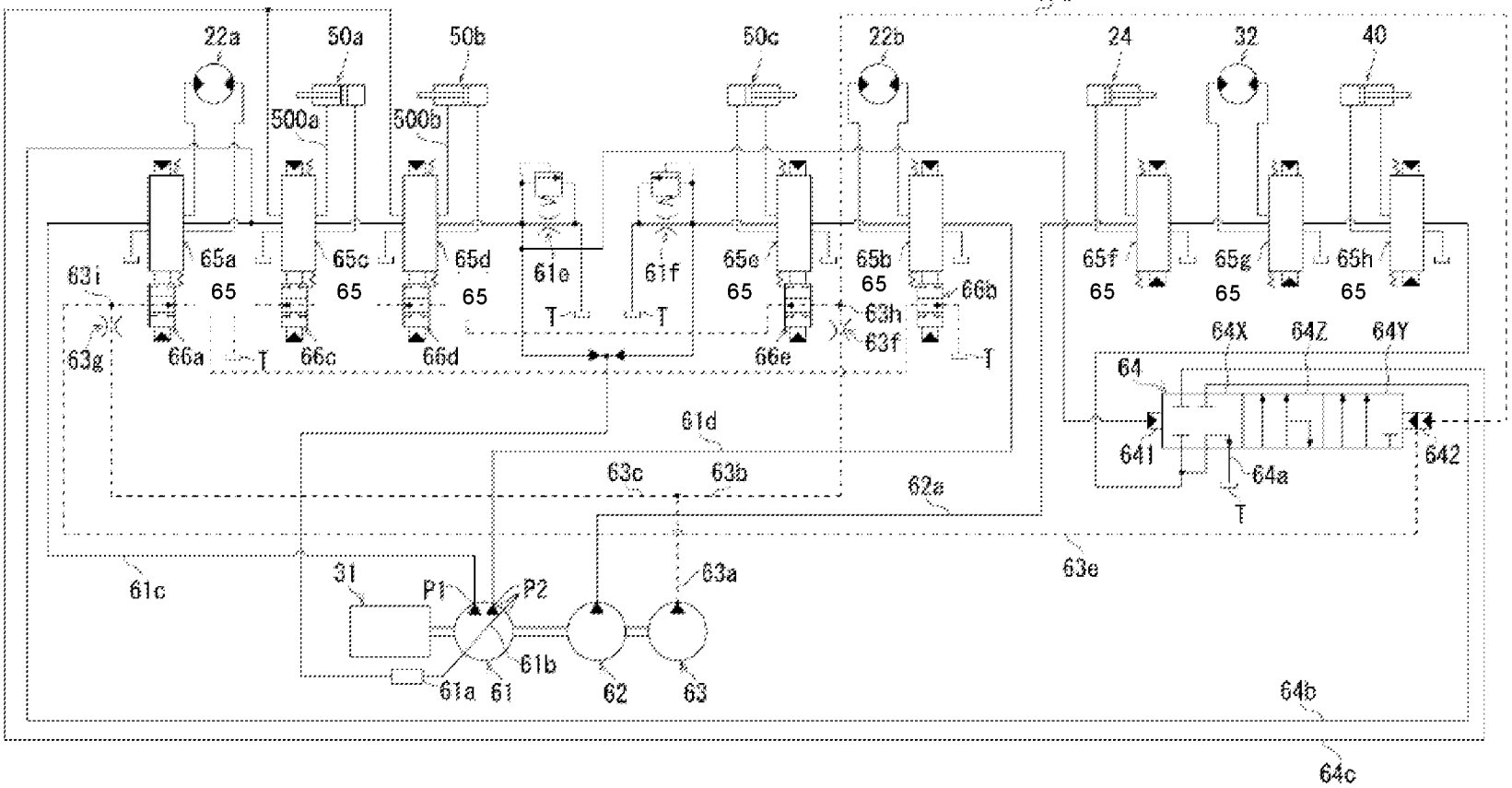
FIG. 2 is a view illustrating a hydraulic circuit for the construction machine according to an embodiment of the present disclosure.

A hydraulic circuit 6 included in the construction machine 1 will be described with reference to FIG. 2. The hydraulic circuit 6 includes a first traveling motor 22*a*, a second traveling motor 22*b* (any one of the left traveling motor 22 and the right traveling motor 22), a first work machine actuator 50*a*, a second work machine actuator 50*b*, a third work machine actuator 50*c* (any one of the boom cylinder 51*a*, the arm cylinder 52*a*, and the bucket cylinder 53*a*), the blade cylinder 24, the turning motor 32, the swing cylinder 40, a variable-volume pump 61, a fixed-volume pump 62, a pilot pump 63, and a distribution direction-switching valve 64.

The variable-volume pump 61 and the fixed-volume pump 62 are driven by the engine 31, thereby discharging the hydraulic oil to be supplied to hydraulic actuators (i.e., the first work machine actuator 50*a*, the second work machine actuator 50*b*, the third work machine actuator 50*c*, the first traveling motor 22*a*, the second traveling motor 22*b*, the blade cylinder 24, the turning motor 32, and the swing cylinder 40). The variable-volume pump 61 supplies the hydraulic oil to and thereby drives the first work machine actuator 50*a*, the second work machine actuator 50*b*, the third work machine actuator 50*c*, the first traveling motor 22*a*, and the second traveling motor 22*b*. The fixed-volume pump 62 supplies the hydraulic oil to and thereby drives the blade cylinder 24, the turning motor 32, and the swing cylinder 40.

The variable-volume pump 61 drives a pump regulator 61*a* to change an inclination angle of a movable swash plate 61*b*, thereby enabling control of a discharge flow rate of the hydraulic oil. The pump regulator 61*a* is driven by a first neg-con pressure or a second neg-con pressure which are described later.

The variable-volume pump 61 is a so-called sprit flow type hydraulic pump which includes a first discharge port P1 and a second discharge port P2. The hydraulic oil discharged from the first discharge port P1 is supplied via a first center bypass oil path 61*c* to a first traveling direction-switching valve 65*a*, a first work machine direction-switching valve 65*c*, and a second work machine direction-switching valve 65*d* which are described later, which are described later, whereas the hydraulic oil discharged from the second discharge port P2 is supplied via a second center bypass oil path 61*d* to a second traveling direction-switching valve 65*b* and a third work machine direction-switching valve 65*e* which are described later. The first center bypass oil path 61*c* and the second center bypass oil path 61*d* finally lead to an oil tank T.

The hydraulic oil discharged from the fixed-volume pump 62 is supplied via a third center bypass oil path 62*a* to a blade direction-switching valve 65*f*, a turning direction-switching valve 65*g*, and a swing direction-switching valve 65*h*.

A first neg-con throttle 61*e* is provided most downstream of the first center bypass oil path 61*c*. The first neg-con throttle 61*e* restricts the flow of the hydraulic oil flowing through the first center bypass oil path 61*c*, thereby generating a first neg-con pressure upstream of the first neg-con throttle 61*e*. Similarly, a second neg-con throttle 61*f* is provided most downstream of the second center bypass oil path 61*d*. The second neg-con throttle 61*f* regulates the flow of the hydraulic oil flowing through the second center bypass oil path 61*d*, thereby generating a second neg-con pressure upstream of the second neg-con throttle 61*f*. Using the first neg-con pressure or the second neg-con pressure as a neg-con signal, the pump regulator 61*a* is driven based on the neg-con signal, whereby the discharge flow rate of the hydraulic oil from the variable-volume pump 61 is controlled. Specifically, the discharge flow rate of the variable-volume pump 61 is increased as the first neg-con pressure and the second neg-con pressure are lower.

The hydraulic actuators (the first machine actuator 50*a*, the second work machine actuator 50*b*, the third work machine actuator 50*c*, the first traveling motor 22*a*, the second traveling motor 22*b*, the blade cylinder 24, the turning motor 32, and the swing cylinder 40) are respectively provided with corresponding direction-switching valves 65. The direction-switching valves 65 are pilot direction-switching valves capable of switching the direction and volume of the hydraulic oil to be forcibly fed to the hydraulic actuators from the variable-volume pump 61 and the fixed-volume pump 62. The direction-switching valve 65 is switchable among a plurality of positions by sliding a spool. When no pilot signal pressure is applied to both two pilot ports of the direction-switching valve 65, the direction-switching valve 65 is kept in its neutral position by an urging force of a spring. When the direction-switching valve 65 is in the neutral position, the hydraulic oil is not supplied to a corresponding hydraulic actuator. Meanwhile, when a pilot signal pressure is applied to one of the pilot ports of the direction-switching valves 65, the direction-switching valve 65 is switched from the neutral position to another position, whereby the hydraulic oil is supplied to another corresponding hydraulic actuator.

In the present embodiment, the first traveling direction-switching valve 65*a* corresponding to the first traveling motor 22*a*, the second traveling direction-switching valve 65*b* corresponding to the second traveling motor 22*b*, the first work machine direction-switching valve 65*c* corresponding to the first work machine actuator 50*a*, the second work machine direction-switching valve 65*d* corresponding to the second work machine actuator 50*b*, the third work machine direction-switching valve 65*e* corresponding to the third work machine actuator 50*c*, the blade direction-switching valve 65*f* corresponding to the blade cylinder 24, the turning direction-switching valve 65*g* corresponding to the turning motor 32, and the swing direction-switching valve 65*h* corresponding to the swing cylinder 40, are provided as the direction-switching valves 65. These direction-switching valves are collectively referred to as control valves.

The pilot pump 63 discharges the pilot oil as a command which is mainly input to the direction-switching valve 65. In FIG. 2, however, an oil path from the pilot pump 63 to the direction-switching valve 65 is not illustrated. The pilot pump 63 is driven by the engine 31 so as to discharge the hydraulic oil, thereby generating a pilot signal pressure in the oil path.

An oil path 63*a* connected to the pilot pump 63 is branched into a work machine detection oil path 63*b* and a traveling detection oil path 63*c*. The work machine detection oil path 63*b* returns to the oil tank T, via a third work machine detection direction-switching valve 66*e* which moves in conjunction with the third work machine direction-switching valve 65*e*, a second work machine detection direction-switching valve 66*d* which moves in conjunction with the second work machine direction-switching valve 65*d*, and a first work machine detection direction-switching valve 66*c* which moves in conjunction with the first work machine direction-switching valve 65*c*. The traveling detection oil path 63*c* leads to the oil tank T, via a first traveling detection direction-switching valve 66*a* which moves in conjunction with the first traveling direction-switching valve 65*a*, and a second traveling detection direction-switching valve 66*b* which moves in conjunction with the second traveling direction-switching valve 65*b*.

The first work machine detection direction-switching valve 66*c* is integrated with the first work machine direction-switching valve 65*c*, and operates in conjunction with the first work machine direction-switching valve 65*c*. The first work machine detection direction-switching valve 66*c* is switchable among a plurality of positions by sliding the spool. When the first work machine direction-switching valve 65*c* is held in the neutral position, the first work machine detection direction-switching valve 66 is also held in the neutral position. When the first work machine direction-switching valve 65*c* is switched from the neutral position to another position, the first work machine detection direction-switching valve 66*c* is also switched from the neutral position to another position in conjunction with this.

When the first work machine detection direction-switching valve 66*c* is in the neutral position, the first work machine detection direction-switching valve 66*c* does not close the work machine detection oil path 63*b*. Therefore, the hydraulic oil is able to flow via the work machine detection oil path 63*b*. Meanwhile, when the first work machine detection direction-switching valve 66*c* is in a position other than the neutral position, the first work machine detection direction-switching valve 66*c* closes the work machine detection oil path 63*b*. That is, the first work machine detection direction-switching valve 66*c* is allowed to be switched to between a communication position in which the work machine detection oil path 63*b* is brought into communication and a shut-off position in which the work machine detection oil path 63*b* is shut off.

Similarly, the second work machine detection direction-switching valve 66*d* and the third work machine detection direction-switching valve 66*e* are allowed to be switched to between a communication position in which the work machine detection oil path 63*b* is brought into communication and a shut-off position in which the work machine detection oil path 63*b* is shut off. Furthermore, similarly, the first traveling detection direction-switching valve 66*a* and the second traveling detection direction-switching valve 66*b* are allowed to be switched to between a communication position in which the traveling detection oil path 63*c* is brought into communication and a shut-off position in which the traveling detection oil path 63*c* is shut off.

The work machine detection oil path 63*b* is branched into a first signal oil path 63*d* upstream of the third work machine detection direction-switching valve 66*e*. A first signal oil path 63*d* is connected to a second signal reception unit 642 of the distribution direction-switching valve 64 described later. When a work machine control lever is operated to move the first work machine detection direction-switching valve 66*c* which is operatively associated with the first work machine direction-switching valve 65*c*, the second work machine detection direction-switching valve 66*d* which is operatively associated with the second work machine direction-switching valve 65*d*, or the third work machine detection direction-switching valve 66*e* which is operatively associated with the third work machine direction-switching valve 65*e*, from its neutral position to a position other than the neutral position, the work machine detection oil path 63*b* is thereby closed, so that a first detection pressure is generated at a work machine detection unit 63*h* located downstream of a first detection pressure generation throttle 63*f*. That is, the work machine detection unit 63*h* detects actuation of the first work machine actuator 50*a*, the second work machine actuator 50*b*, or the third work machine actuator 50*c*, and is allowed to output the first detection pressure. The first detection pressure is input as a first detection signal to the second signal reception unit 642 via the first signal oil path 63*d*.

Similarly, the traveling detection oil path 63*c* is branched to the second signal oil path 63*e* upstream of the first traveling detection direction-switching valve 66*a*. A second signal oil path 63*e* is connected to the second signal reception unit 642 of the distribution direction-switching valve 64 described later. When a traveling lever is operated to move the first traveling detection direction-switching valve 66*a* which is operatively associated with the first traveling direction-switching valve 65*c*, or the second traveling detection direction-switching valve 66*b* which is operatively associated with the second traveling direction-switching valve 65*b*, from its neutral position to a position other than the neutral position, the traveling detection oil path 63*c* is thereby closed, so that a second detection pressure is generated at a traveling detection unit 63*i* located downstream of a second detection pressure generation throttle 63*g*. That is, the traveling detection unit 63*i* detects actuation of the first traveling motor 22*a* or the second traveling motor 22*b*, and is allowed to output the second detection pressure. The second detection pressure is input as a second detection signal to the second signal reception unit 642 via the second signal oil path 63*e*.

The third center bypass oil path 62*a* includes the distribution direction-switching valve 64 downstream of the swing direction-switching valve 65*h*. A first oil path 64*a* connected to the oil tank T, a second oil path 64*b* connected to the first center bypass oil path 61*c*, and a third oil path 64*c* connected to the first work machine direction-switching valve 65*c* and the second work machine direction-switching valve 65*d* are provided downstream of the distribution direction-switching valve 64. This allows the hydraulic oil flowing through the third center bypass oil path 62*a* to be supplied to the oil tank T, the first center bypass oil path 61*c*, the first work machine direction-switching valve 65*c*, or the second work machine direction-switching valve 65*d*, via the distribution direction-switching valve 64.

The second oil path 64*b* is connected between the first traveling motor 22*a* and the first work machine actuator 50*a*, and more specifically, connected to the first center bypass oil path 61*c* between the first traveling direction-switching valve 65*a* and the first work machine direction-switching valve 65*c*.

The third oil path 64*c* is connected to a first meter-in oil path 500*a* of the first work machine actuator 50*a* via the first work machine direction-switching valve 65*c*, and is also connected to a second meter-in oil path 500*b* of the second work machine actuator 50*b* via the second work machine direction-switching valve 65*d*.

The distribution direction-switching valve 64 is switchable among a position 64X, a position 64Y, and a position 64Z by sliding the spool. When the distribution direction-switching valve 64 is in the position 64X illustrated in FIG. 2, the third center bypass oil path 62*a* is in communication with the first oil path 64*a*. When the distribution direction-switching valve 64 is in the position 64Y, the third center bypass oil path 62*a* is in communication with the second oil path 64*b* and the third oil path 64*c*. When the distribution direction-switching valve 64 is in the position 64Z, the third center bypass oil path 62*a* is in communication with the first oil path 64*a*, the second oil path 64*b*, and the third oil path 64*c*. Thus, sliding the spool allows the distribution direction-switching valve 64 to form the first oil path 64*a* from the fixed-volume pump 62 to the oil tank T, the second oil path 64*b* from the fixed-volume pump 62 to the first center bypass oil path 61*c*, and the third oil path 64*c* from the fixed-volume pump 62 to both the first meter-in oil path 500*a* of the first work machine actuator 50*a* and the second meter-in oil path 500*b* of the second work machine actuator 50*b*.

The distribution direction-switching valve 64 includes a first signal reception unit 641 and the second signal reception unit 642. The first signal reception unit 641 receives a signal for sliding the spool in a direction for forming the first oil path 64*a*, that is, a direction for switching to the position 64X or the position 64Z. The second signal reception unit 642 receives a signal for sliding the spool in a direction for forming the second oil path 64*b*, that is, a direction for switching to the position 64Y or the position 64Z.

The first signal oil path 63*d* and the second signal oil path 63*e* are connected to the second signal reception unit 642. The second signal reception unit 642 is able to receive a signal based on the first detection signal for detecting actuation of the first work machine actuator 50*a*, the second work machine actuator 50*b*, or the third work machine actuator 50*c*, and a signal based on the second detection signal for detecting actuation of the first traveling motor 22*a* or the second traveling motor 22*b*. In the case in which the second signal reception unit 642 receives the first detection signal and the second direction signal, that is, in the case in which the work machine actuator (the first work machine actuator 50*a*, the second work machine actuator 50*b*, or the third work machine actuator 50*c*) and the traveling motor (the first traveling motor 22*a* or the second traveling motor 22*b*) are operated in combination, the distribution direction-switching valve 64 is switched to the position 64Y or the position 64Z.

The first neg-con pressure is input to the first signal reception unit 641. The first signal reception unit 641 is able to receive the first neg-con pressure as a neg-con signal. When the first signal reception unit 641 receives a signal based on the neg-con signal, the distribution direction-switching valve 64 is switched to the position 64X or the position 64Z.

The distribution direction-switching valve 64 is switched to the position 64X, the position 64Y, or the position 64Z, according to the neg-con signal received by the first signal reception unit 641 and a difference in magnitude between the first detection signal and the second detection signal which are received by the second signal reception unit 642.

For example, when the first work machine actuator 50*a* or the second work machine actuator 50*b* is relatively largely operated during a combined operation, the second signal reception unit 642 receives the first detection signal and the second detection signal, the first neg-con pressure is low, and the neg-con signal received by the first signal reception unit 641 is small. Thus, the distribution direction-switching valve 64 is switched to the position 64Y. At this time, the second oil path 64*b*, which extends from the fixed-volume pump 62 to the first center bypass oil path 61*c*, is formed, and the third oil path 64*c*, which extends from the fixed-volume pump 62 to the first meter-in oil path 500*a* of the first work machine actuator 50*a* and the second meter-in oil path 500*b* of the second work machine actuator 50*b*, is formed. Accordingly, a large amount of hydraulic oil is able to be supplied from the fixed-volume pump 62 to the first work machine actuator 50*a* and the second work machine actuator 50*b*.

Meanwhile, when the first work machine actuator 50*a* or the second work machine actuator 50*b* is relatively slightly operated during the combined operation, the second signal reception unit 642 receives the first detection signal and the second detection signal, the first neg-con pressure is high, and the neg-con signal received by the first signal reception unit 641 is large. Thus, the distribution direction-switching valve 64 is switched to the position 64X. At this time, the first oil path 64*a* from the fixed-volume pump 62 to the oil tank T is formed. Accordingly, the hydraulic oil from the fixed-volume pump 62 is not supplied to the first work machine actuator 50*a* or not supplied to the second work machine actuator 50*b*.

Furthermore, the first work machine actuator 50*a* or the second work machine actuator 50*b* is moderately operated during the combined operation, the distribution direction-switching valve 64 is switched to the position 64Z. At this time, the first oil path 64*a*, which extends from the fixed-volume pump 62 to the oil tank T, is formed, the second oil path 64*b*, which extends from the fixed-volume pump 62 to the first center bypass oil path 61*c* is formed, and the third oil path 64*c*, which extends from the fixed-volume pump 62 to the first meter-in oil path 500*a* of the first work machine actuator 50*a* and the second meter-in oil path 500*b* of the second work machine actuator 50*b*, is formed. Accordingly, the hydraulic oil from the fixed-volume pump 62 is partly returned to the oil tank T, and partly supplied to the first work machine actuator 50*a* and the second work machine actuator 50*b*.

As described above, the hydraulic circuit 6 of the construction machine 1 of the present embodiment includes the engine 31, the variable-volume pump 61 and the fixed-volume pump 62 which are driven by the engine 31, the first center bypass oil path 61*c* extending from the variable-volume pump 61 to the oil tank T, and the neg-con throttle 61*e* positioned most downstream of the center bypass oil path 61*c*, the hydraulic circuit 6 being configured to detect a first neg-con pressure upstream of the first neg-con throttle 61*e* as a neg-con signal, and to control the variable-volume pump 61 based on the neg-con signal, further includes the distribution direction-switching valve 64 including the first oil path 64*a* extending from the fixed-volume pump 62 to the oil tank T, and a second oil path 64*b* through which the hydraulic oil extending from the fixed-volume pump 62 to the first center bypass oil path 61*c*, the first oil path 64*a* and the second oil path 64*b* being formed by sliding of a spool, in which the distribution direction-switching valve 64 includes the first signal reception unit 641 for receiving a signal for sliding the spool in a direction forming the first oil path 64*a*, and the second signal reception unit 642 for receiving a signal for sliding the spool in a direction forming the second oil path 64*b*, a distribution ratio of the hydraulic oil to be supplied to the first oil path 64*a* and the second oil path 64*b* is determined according to a difference in magnitude between the signals respectively received by the first signal reception unit 641 and the second signal reception unit 642, and the first signal reception unit 641 receives a signal based on the neg-con signal.

According to this configuration, in the hydraulic circuit 6 of the construction machine 1 in which the work machine actuators are driven while joining the hydraulic oil from the fixed-volume pump 62 to the first center bypass oil path 61*c* which extends from the negative control variable-volume pump 61 to the oil tank T, the hydraulic oil flowing from the fixed-volume pump 62 to the first center bypass oil path 61*c* is partly returned to the oil tank T based on a magnitude of the neg-con signal generated at the first neg-con throttle 61*e* located downstream of the first center-bypass oil path 61*c*, whereby the rate of flow flowing from the fixed-volume pump 62 to the first center bypass oil path 61*c* is able to be controlled dependent on the required flow rate of the work machine actuators.

Furthermore, in the present embodiment, a second center bypass oil path 61*d*, which extends from the variable-volume pump 61 to the oil tank T and which is different from the first center bypass oil path 61*c*, is further provided, the first center bypass oil path 61*c* includes a first traveling motor 22*a*, a first work machine actuator 50*a* and a second work machine actuator 50*b* which are positioned downstream of the first traveling motor 22*a*, the second center bypass oil path 61*d* includes the second traveling motor 22*b*, and the second oil path 64*b* is in communication with the first center bypass oil path 61*c* between the first traveling motor 22*a* and the first and second work machine actuators 50*a* and 50*b*.

According to this configuration, the first traveling motor 22*a*, the first work machine actuator 50*a*, and the second work machine actuator 50*b* are provided upstream of the first center bypass oil path 61*c*, and the hydraulic oil from the fixed-volume pump 62 is joined between the first traveling motor 22*a* and the first and second work machine actuators 50*a* and 50*b*, whereby the hydraulic oil flowing through the first center bypass oil path 61*c* from the fixed-volume pump 62 is not used by the first traveling motor 22*a*. Accordingly, the neg-con signal detected from the first center bypass oil path 61*c* corresponds to a required flow rate of the first and second work machine actuators 50*a* and 50*b*, so that the rate of flow flowing from the fixed-volume pump 62 to the first center bypass oil path 61*c* is able to be controlled according to the required flow rate of the first and second work machine actuators 50*a* and 50*b*.

Furthermore, in the present embodiment, the second signal reception unit 642 receives a signal based on the first detection signal for detecting actuation of the first work machine actuator 50*a*, the second work machine actuator 50*b*, or the third work machine actuator 50*c*, and the second detection signal for detecting actuation of the first traveling motor 22*a* or the second traveling motor 22*b*.

According to the configuration described above, even if a circuit is designed so that during the combined operation of one of the first work machine actuator 50*a*, the second work machine actuator 50*b*, and the third work machine actuator 50*c* (i.e., the work machine actuator) and one of the traveling motor 22*a* and the second traveling motor 22*b* (i.e., the traveling motor), the hydraulic oil from the fixed-volume pump 62 having no ability to control a pump flow rate is joined to the first center bypass oil path 61*c* extending from the negative control variable-volume pump 61, in which the work machine actuator is disposed, so that the required flow rate of the work machine actuators during a large operation is able to be satisfied, it is possible to satisfy the required flow rate of the work machine actuators during a slight operation by returning a part of the hydraulic oil flowing from the fixed-volume pump 62 through the center bypass oil path 61*c*, to the oil tank T based on the magnitude of a neg-con signal detected by the first neg-con throttle 61*e* located downstream of the first center bypass oil path 61*c*.

Furthermore, in the present embodiment, the distribution direction-switching valve 64 includes the third oil path 64*c* which is formed in response that the second signal reception unit 642 receives a signal, and which extends from the fixed-volume pump 62 to the first meter-in oil path 500*a* of the first work machine actuator 50*a* and the second meter-in oil path 500*b* of the second work machine actuator 50*b*.

According to this configuration, joining the hydraulic oil from the fixed-volume pump 62 to the meter-in oil path of the work machine actuator results in directly sending the hydraulic oil from the fixed-volume pump 62 to the work machine actuator, which in turn makes it possible to ensure the movement of the work machine actuator during the combined operation of the work machine actuator and the traveling motor.

The hydraulic circuit 6 of the present embodiment includes the variable-volume pump 61 which is driven by the engine 31, the fixed-volume pump 62 which is driven by the engine 31, the first center bypass oil path 61*c* extending from the variable-volume pump 61 to the oil tank T, the first neg-con throttle 61*e* positioned in the first center bypass oil path 61*c*, the first neg-con throttle 61*e* being configured to detect a first neg-con pressure upstream thereof as a neg-con signal, and to control the variable-volume pump 61 based on the neg-con signal, and the distribution direction-switching valve 64 including the first oil path 64*a* leading the hydraulic oil from the fixed-volume pump 62 to the oil tank T, and a second oil path 64*b* leading the hydraulic oil from the fixed-volume pump 62 to the first center bypass oil path 61*c*.

Furthermore, in the present embodiment, the first neg-con throttle 61*e* is provided most downstream of the first center bypass oil path 61*c*.

Furthermore, in the present embodiment, the distribution direction-switching valve 64 switches the hydraulic oil from the fixed-volume pump 62 to the first oil path 64*a* or the second oil path 64*b* according to a spool position.

Furthermore, in the preset embodiment, the distribution direction-switching valve 64 includes the first signal reception unit 641 for receiving a signal for moving the spool in a direction forming the first oil path 64*a*, and the second signal reception unit 642 for receiving a signal for moving the spool in a direction forming the second oil path 64*b*.

Furthermore, in the present embodiment, a distribution ratio of the hydraulic oil to be supplied to the first oil path 64*a* and the second oil path 64*b* is determined according to a difference in magnitude between the signals respectively received by the first signal reception unit 641 and the second signal reception unit 642, and the first signal reception unit 641 receives a signal based on the neg-con signal.

(Other Embodiments) In the present disclosure described above, the variable-volume pump is a split flow type variable-volume pump 61 which includes a first discharge port P1 and the second discharge port P2, but this is not restrictive. For example, the variable-volume pump may be a tandem type variable-volume pump which is composed of a first variable-volume pump including a first discharge port P1 and a second variable-volume pump composed of a second discharge port P2. Furthermore, in the tandem type variable-volume pump, the discharge flow rates of the two variable-volume pumps may be controlled by a single pump regulator or may be controlled by different pump regulators.

In the embodiment described above, the hydraulic circuit 6 provided in the construction machine is described. However, the hydraulic circuit according to the present embodiment may be applied to work vehicles, etc., other than construction machines.

Although the embodiments according to the present disclosure have been described with reference to the drawings, it should be considered that a specific configuration is not limited to the embodiments. The scope of the present disclosure is indicated by the claims as well as the description of the embodiments described above, and all modifications which come within the meaning and range of equivalency of the claims are to be embraced within their scope.

DESCRIPTION OF REFERENCE NUMERALS

1 Construction machine
2 Lower traveling body
3 Revolving superstructure
5 Work machine
6 Hydraulic circuit
22*a* First traveling motor
22*b* Second traveling motor
50*a* First work machine actuator
50*b* Second work machine actuator
50*c* Third work machine actuator
31 Engine
61 Variable-volume pump
61*c* First center bypass oil path
61*d* Second center bypass oil path
61*e* First neg-con throttle
62 Fixed-volume pump
62*a* Third center bypass oil path
64 Distribution direction-switching valve
64*a* First oil path

64*b* Second oil path
64*c* Third oil path
641 First signal reception unit
642 Second signal reception unit
T Oil tank

The invention claimed is:

1. A hydraulic circuit for a construction machine, the hydraulic circuit comprising:

an engine;

a variable-volume pump and a fixed-volume pump which are driven by the engine;

a center bypass oil path extending from the variable-volume pump to an oil tank; and a negative control throttle positioned most downstream of the center bypass oil path, the hydraulic circuit being to detect an oil pressure upstream of the negative control throttle as a negative control signal, and to control the variable-volume pump based on the negative control signal, the hydraulic circuit further comprising a direction-switching valve including a first oil path extending from the fixed-volume pump to the oil tank and a second oil path extending from the fixed-volume pump to the center bypass oil path, the first oil path and the second oil path being formed by sliding of a spool, wherein the direction-switching valve receives a first signal for sliding the spool in a direction forming the first oil path, and receives a second signal for sliding the spool in a direction forming the second oil path, a distribution ratio of the hydraulic oil to be supplied to the first oil path and the second oil path is determined according to a difference in magnitude between the first signal and the second signal, the first signal is based on the negative control signal.

2. The hydraulic circuit for a construction machine according to claim 1, wherein the hydraulic circuit further comprises an other center bypass oil path different from the center bypass oil path, the other center bypass oil path extending from the variable-volume pump to the oil tank, the center bypass oil path includes a first traveling motor, and a work machine actuator positioned downstream of the first traveling motor, the other center bypass oil path includes a second traveling motor, the second oil path is in communication with the center bypass oil path between the first traveling motor and the work machine actuator.

3. The hydraulic circuit for a construction machine according to claim 2, wherein the second signal is based on a first detection signal for detecting actuation of the work machine actuator and a second detection signal for detecting actuation of the first traveling motor or the second traveling motor.

4. The hydraulic circuit for a construction machine according to claim 3, wherein the direction-switching valve includes a third oil path extending from the fixed-volume pump to a meter-in side oil path of the work machine actuator, the third oil path being formed as the second signal.

5. A hydraulic circuit comprising:

a variable-volume pump which is driven by an engine;

a fixed-volume pump which is driven the engine;

a center bypass oil path extending from the variable-volume pump to an oil tank;

a negative control throttle disposed in the center bypass oil path, the negative control throttle being to detect an oil pressure upstream of the negative control throttle as a negative control signal, and control the variable-volume pump based on the negative control signal; and a direction-switching valve including a first oil path through which a hydraulic oil from the fixed-volume pump leads to the oil tank, and a second oil path through which the hydraulic oil from the fixed-volume pump leads to the center bypass oil path, wherein the negative control throttle is positioned most downstream of the center bypass oil path, the direction-switching valve switches the hydraulic oil from the fixed-volume pump to the first oil path or the second oil path according to a spool position, and the direction-switching valve receives a first signal for moving the spool in a direction forming the first oil path, and receives a second signal for moving the spool in a direction forming the second oil path.

6. The hydraulic circuit according to claim 5, wherein a distribution ratio of the hydraulic oil to be supplied to the first oil path and the second oil path is determined according to a difference in magnitude between the first signal and the second signal, the first signal is based on the negative-control signal.

* * * * *